US007562496B2

(12) United States Patent
Zwiebach

(10) Patent No.: US 7,562,496 B2
(45) Date of Patent: Jul. 21, 2009

(54) MOVING RETAIL SPACE SYSTEM FOR BUILDINGS

(76) Inventor: Luis Salo Zwiebach, Carlos Porras Osores 370, Dep. 901, Lima (PE) 27

( * ) Notice: Subject to any disclaimer, the term of this patent is extended or adjusted under 35 U.S.C. 154(b) by 0 days.

(21) Appl. No.: 11/830,949

(22) Filed: Jul. 31, 2007

(65) Prior Publication Data

US 2009/0031644 A1 Feb. 5, 2009

(51) Int. Cl.
*E04B 1/343* (2006.01)
*E04B 1/36* (2006.01)

(52) U.S. Cl. ..... 52/64; 52/67; 52/72; 52/30; 52/7

(58) Field of Classification Search ..... 52/64, 52/67, 72, 30, 7, 169.9, 169.1, 143, 121
See application file for complete search history.

(56) References Cited

U.S. PATENT DOCUMENTS 2,189,486 A * 2/1940 Amico ..... 52/67
3,008,435 A * 11/1961 Dupuy ..... 109/1 S
3,115,684 A * 12/1963 Joy ..... 52/7
3,399,887 A * 9/1968 Altier ..... 472/75
3,546,827 A 12/1970 Demarais
4,735,024 A * 4/1988 Rosato et al. ..... 52/126.6
5,319,895 A 6/1994 Ray
5,365,704 A * 11/1994 Ray ..... 52/64
5,642,589 A * 7/1997 Miron et al. ..... 52/7
5,794,389 A * 8/1998 Vysma ..... 52/169.6
5,974,743 A * 11/1999 Vaia ..... 52/169.6
6,202,356 B1 * 3/2001 Hock ..... 52/6
6,338,596 B1 * 1/2002 Galeazzi et al. ..... 405/129.5
6,428,419 B1 * 8/2002 Sheldon ..... 472/60
6,457,291 B2 * 10/2002 Wick ..... 52/653.1
6,996,937 B2 * 2/2006 Halloran ..... 52/1

* cited by examiner

*Primary Examiner*—Phi Dieu Tran A
(74) *Attorney, Agent, or Firm*—Albert Bordas, P.A.

(57) ABSTRACT

A moving retail space system for buildings comprising a moving housing that operates within a building structure to allow multiple businesses to be at a street level. The moving housing comprises spaces A and A', and the building structure comprises a basement. A lift assembly moves the moving housing from an initial to a second position, and vice versa. In the initial position a first business operating in space A is at the street level, and a second business operating in space A' is located one floor above the first business. In the second position, the first business operating in space A is in the basement, and the second business operating in space A' is at the street level. At least one locking mechanism laterally secures the moving housing in place. A sealing mechanism prevents objects from falling between the moving housing and the building structure.

8 Claims, 8 Drawing Sheets

MOVING RETAIL SPACE SYSTEM FOR BUILDINGS

BACKGROUND OF THE INVENTION

1. Field of the Invention

The present invention relates to building retail spaces, and more particularly, to a moving retail space system.

2. Description of the Related Art

Several inventions for building retail spaces have been developed in the past. None of them, however, includes, a moving housing that operates within a building structure to allow multiple businesses, vertically disposed with respect to each other on respective multiple contiguous floors, to be at a street level and more accessible to the public.

In metropolitan cities and especially in downtown areas, businesses operating at a street level are often frequented much more than businesses operating in a basement or level above the street level. This is because customers have to take stairs or an elevator to reach those business establishments. As a result, those businesses operating at the street level have better space utilization as compared to businesses in the same building that are in the basement or level above the street level. There is a need of a moving retail space system for buildings comprising a moving housing that operates within a building structure to allow multiple businesses, vertically disposed with respect to each other on respective multiple contiguous floors, to be at a street level and more accessible to the public.

Applicant believes that one of the closest references corresponds to U.S. Pat. No. 5,365,704 issued to Ray on Nov. 22, 1994 for an activity floor changing system for multi-activity complex. However, it differs from the present invention because Ray teaches a multi-activity complex that incorporates a plurality of activity floors, each of which has an associated playing surface and is selectively movable between a storage position, located below an event staging or activity area, and an in-use position located in the activity area. A system is provided for alternatively shifting the activity floors between the respective storage and in-use positions. The shifting system includes a lift assembly for vertically moving the activity floors into and out of the activity area and a second mechanism for laterally shifting the activity floors to and from a respective storage area disposed below and laterally outwardly of the activity area.

Applicant believes another reference corresponds to U.S. Pat. No. 5,319,895 issued to Ray on Jun. 14, 1994 for an activity floor changing system for multi-activity complex. However, it differs from the present invention because Ray teaches a multi-activity complex that incorporates a plurality of activity floors, each of which has an associated playing surface and is selectively movable between a storage position, located below an event staging or activity area, and an in-use position located in the activity area. A system is provided for alternatively shifting the activity floors between the respective storage and in-use positions. The shifting system includes a lift assembly for vertically moving the activity floors into and out of the activity area and a second mechanism for laterally shifting the activity floors to and from a respective storage area disposed below and laterally outwardly of the activity area.

Applicant believes another reference corresponds to U.S. Pat. No. 3,546,827 issued to Demarais on Dec. 15, 1970 for a projectable and retractable enclosed structure. However, it differs from the present invention because Demarais teaches a first platform that supports the enclosed structure and has pillars on the corners, which support a roof structure or second platform, which encloses a pit in which the first platform is retracted to have the roof structure form a cover therefore. A fluid tank, pump and motor provide pressure fluid to a ram at the bottom of the pit that supports the first platform when secured thereto at the center thereof. The roof structure may be used as a sun deck when the first platform is in raised position to cover the area there below, which may be employed as refreshment area for food and drinks.

Applicant believes another reference corresponds to U.S. Pat. No. 5,974,743, issued to Vaia on Nov. 2, 1999 for a system for protecting a building, especially from natural disasters, theft and vandalism. However, it differs from the present invention because Vaia teaches a system for protecting a building (10,100) that includes a rigid flat structure (11,101) on which the building (10,100) rests; a sunken garage (12,110) below ground level (15); vertical telescopic hydraulic jacks (30-33,102,103) extending from the bottom of the sunken garage (12,110) for supporting the flat structure (11,101) at any of a number of positions relative to ground level (15); a device for connecting electrical and telephone lines including at least one flexible cable (70) suspended in the sunken garage (12,110) so as to have a U-shaped bend, at least one pulley (71) arranged at the U-shaped bend and by which the at least one flexible cable (70) passes and at least one traction spring (73) connected to the at least one pulley (71) to act on the at least one flexible cable (70); a device for connecting water supply pipes including at least one flexible tube (80) suspended in the sunken garage (12,110) so as to have a U-shaped bend; and a device for providing drainage including a vertical pipe (91) arranged in the sunken garage (12,110) or near the sunken garage and having fixed couplers (92,93,94) arranged at respective heights relative to ground level corresponding to the allowed positions of the building, at least one telescopic connector (25) connected to at least one horizontal branch pipe (24) in the building and at least one manual or automatic control device (26) for operating the at least one telescopic connector (25).

Applicant believes another reference corresponds to Japanese Patent No. 402282545A, issued to Baba, Shinji on Nov. 20, 1990 for a system for an indoor space doubly utilizing system. However, it differs from the present invention because Baba teaches a fixed space room 40, a moving space room 41 provided on a first floor, a fixed space room 42 that is provided on the moving space room 41, and a moving space room 43 that is provided on the fixed space room 40 respectively on the second floor. A fixed floor 48*a* and a ceiling 53 are provided in the fixed space room 42, and a moving floor 56 is vertically movably provided in the moving space room 43. When the moving floor 56 is located at a lowermost position, a ceiling space 57 is formed between a fixed floor 45*a* and the moving floor 56. An attic space 58 is formed between the moving floor 56 and a ceiling 55, and an underfloor space 50 is formed between a moving floor 49 and a fixed floor 47 respectively. The dwelling environment can be changed.

Other patents describing the closest subject matter provide for a number of more or less complicated features that fail to solve the problem in an efficient and economical way. None of these patents suggests the novel features of the present invention.

SUMMARY OF THE INVENTION

The instant invention is a moving retail space system for buildings, comprising a moving housing having at least defined spaces A and A'. Spaces A and A' are vertically disposed with respect to each other on respective multiple contiguous floors. A building structure houses the moving housing, and comprises a basement positioned below a street level. A lift assembly is housed within the building structure. The lift assembly comprises bases, exterior cylinders, mounts, pistons, and exterior cylinder tops. The bases are mounted to a basement floor of the basement. The exterior cylinder tops are mounted to an upper end of the exterior cylinders to telescopically receive respective the pistons therethrough. The lift assembly is synchronized to move the moving housing from an initial position to a second position, and vice versa. In the initial position, a first business operating in space A is at the street level, and a second business operating in space A' is located one floor above the first business operating in space A. In the second position, the first business operating in space A is in the basement B, and the second business operating in space A' is at the street level. At least one locking mechanism comprises a housing lock, a lock base, a shaft, a spring and a locking element. The locking mechanism laterally secures the moving housing in place. At least one sealing mechanism prevents objects from falling between the moving housing and the building structure.

Each sealing mechanism comprises a housing lock, a lock base, a shaft, a spring, a locking element, an elongated member, and a sealing member. The sealing member comprises a horizontal portion and extending vertical member that extends a predetermined distance downwardly between the moving housing and the building structure. The moving housing comprises floors, ceilings, front walls, rear walls, and sidewalls that define spaces A and A'. I-shape beams are mounted at an underside of the floors. The moving housing has at least one sensor mounted to an underside of one floor that emits a signal to the basement floor. If an object is identified as occupying space within the basement, an electronic signal is sent to an electrical box to prevent the moving housing from moving from the initial position to the second position. The object can be a vehicle, person, or waste. The moving housing could further comprise common areas including restrooms, kitchens, sinks and a flexible piping system connected to the building structure.

It is therefore one of the main objects of the present invention to provide a moving retail space system for buildings comprising a moving housing that operates within a building structure to allow multiple businesses, vertically disposed with respect to each other on respective multiple contiguous floors, to be at a street level and more accessible to the public.

It is another object of this invention to provide a moving retail space system for buildings comprising a moving housing that operates within a building structure having a basement, a street level, and a second floor levels to allow the businesses operating from the basement and second floor level to be positioned at a street level and more accessible to the public.

It is another object of this invention to provide a moving retail space system for buildings to allow the businesses operating from the basement and second floor level to be positioned at a street level and more accessible to the public at predetermined times.

It is still another object of the present invention to provide a moving retail space system for buildings having a locking mechanism that laterally secures the moving housing in place once it achieves a desired position.

It is another object of the present invention to provide a moving retail space system for buildings having a locking mechanism that is connected to an energy source, and once the locking mechanism is engaged, the energy source is turned off to save energy and prevent the locking mechanism from disengaging.

It is still another object of the present invention to provide a moving retail space system for buildings that comprises a sealing mechanism to prevent small objects, such as key chains, from falling through a gap defined between the moving housing and the building structure.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
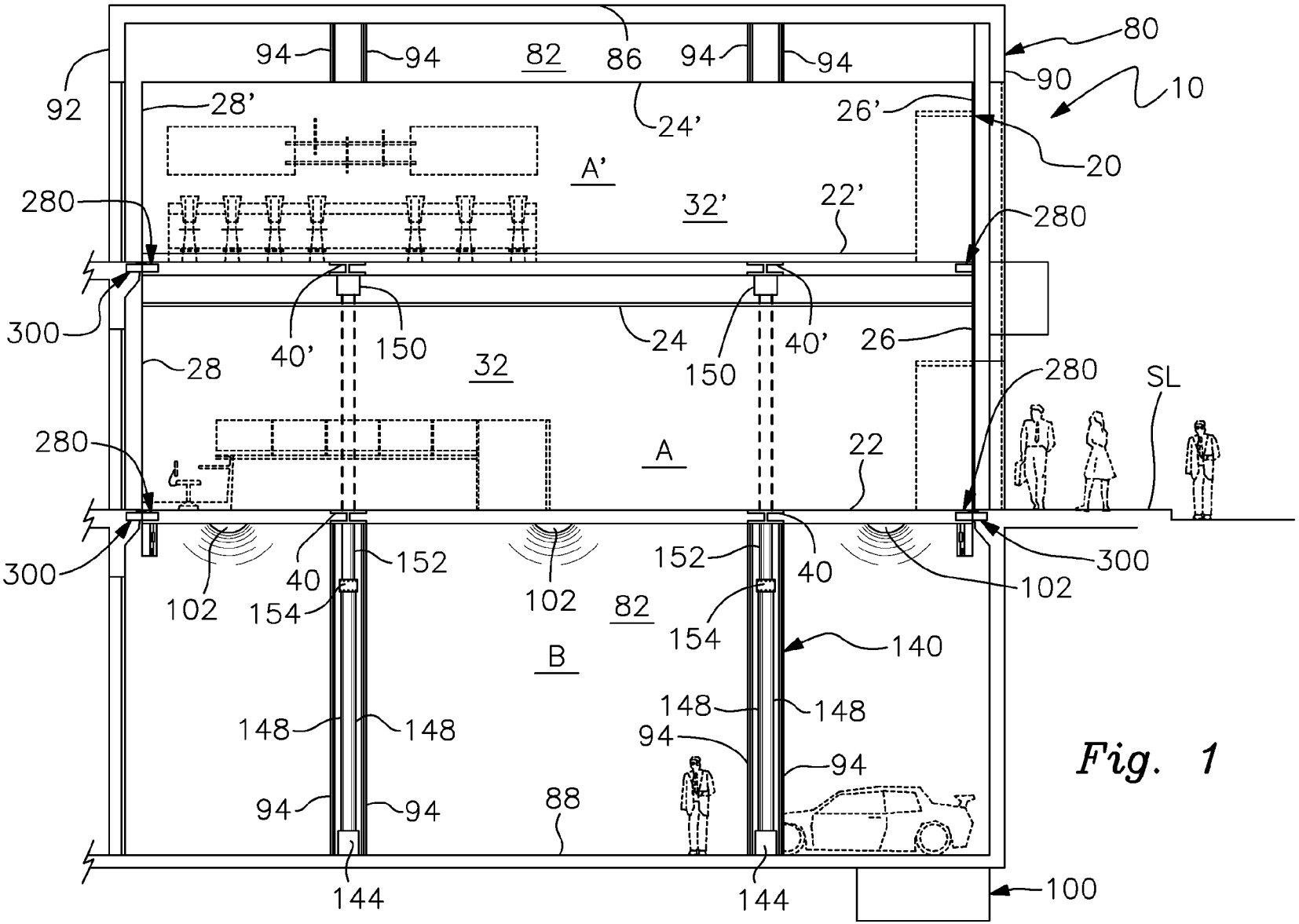
FIG. 1 represents a schematic side view of the instant invention in an initial position, wherein a business operating in space A is at street level, and a business operating in space A' is one level above the business operating in space A.

Referring now to the drawings, where the moving retail space system for buildings is generally referred to with numeral 10, it can be observed that it basically includes moving housing 20, building structure 80, lift assembly 140, locking mechanism 180, and sealing mechanism 280.

Figure 2:
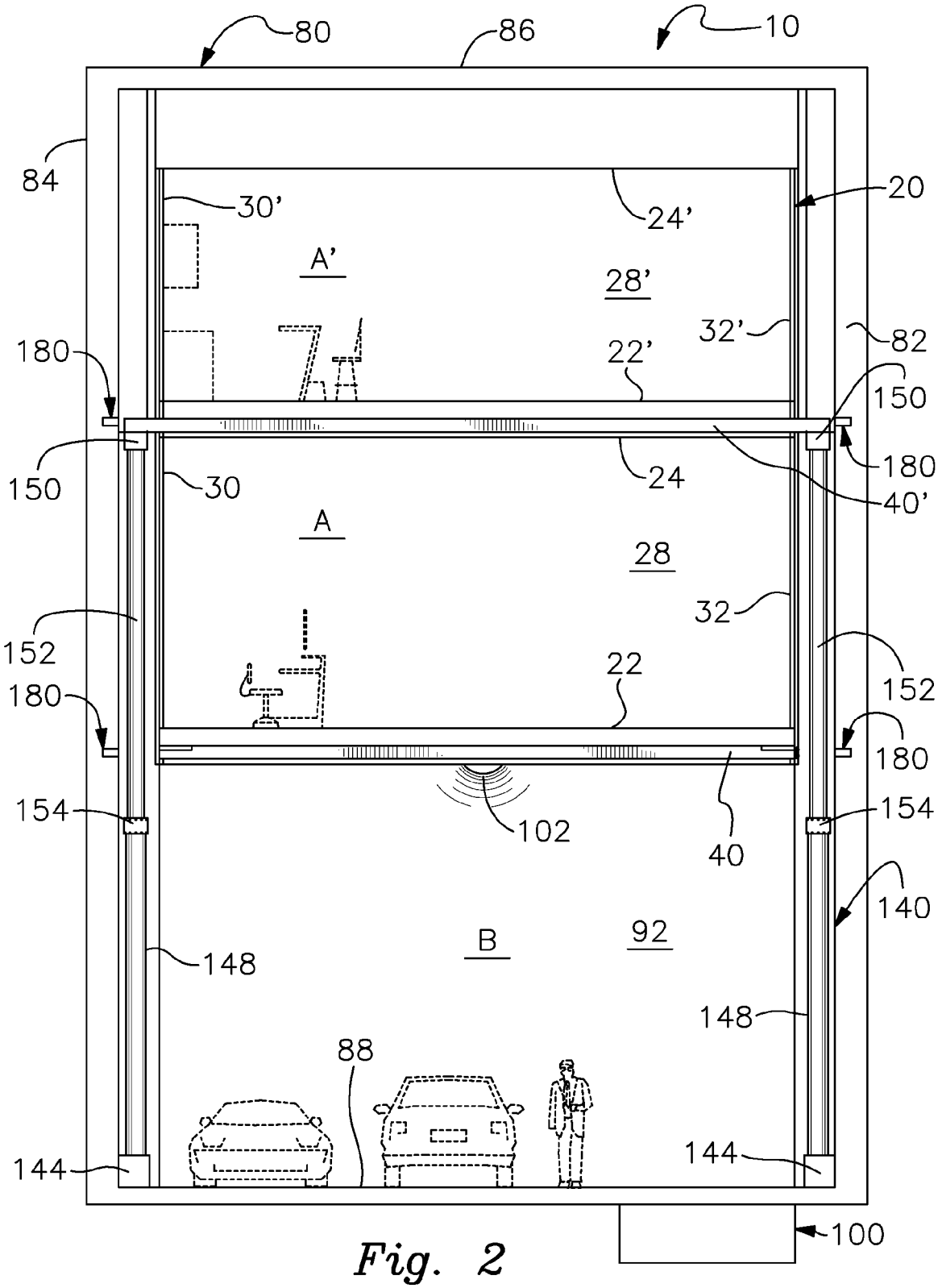
FIG. 2 is a schematic front view of the instant invention as seen in FIG. 1.
Figure 3:
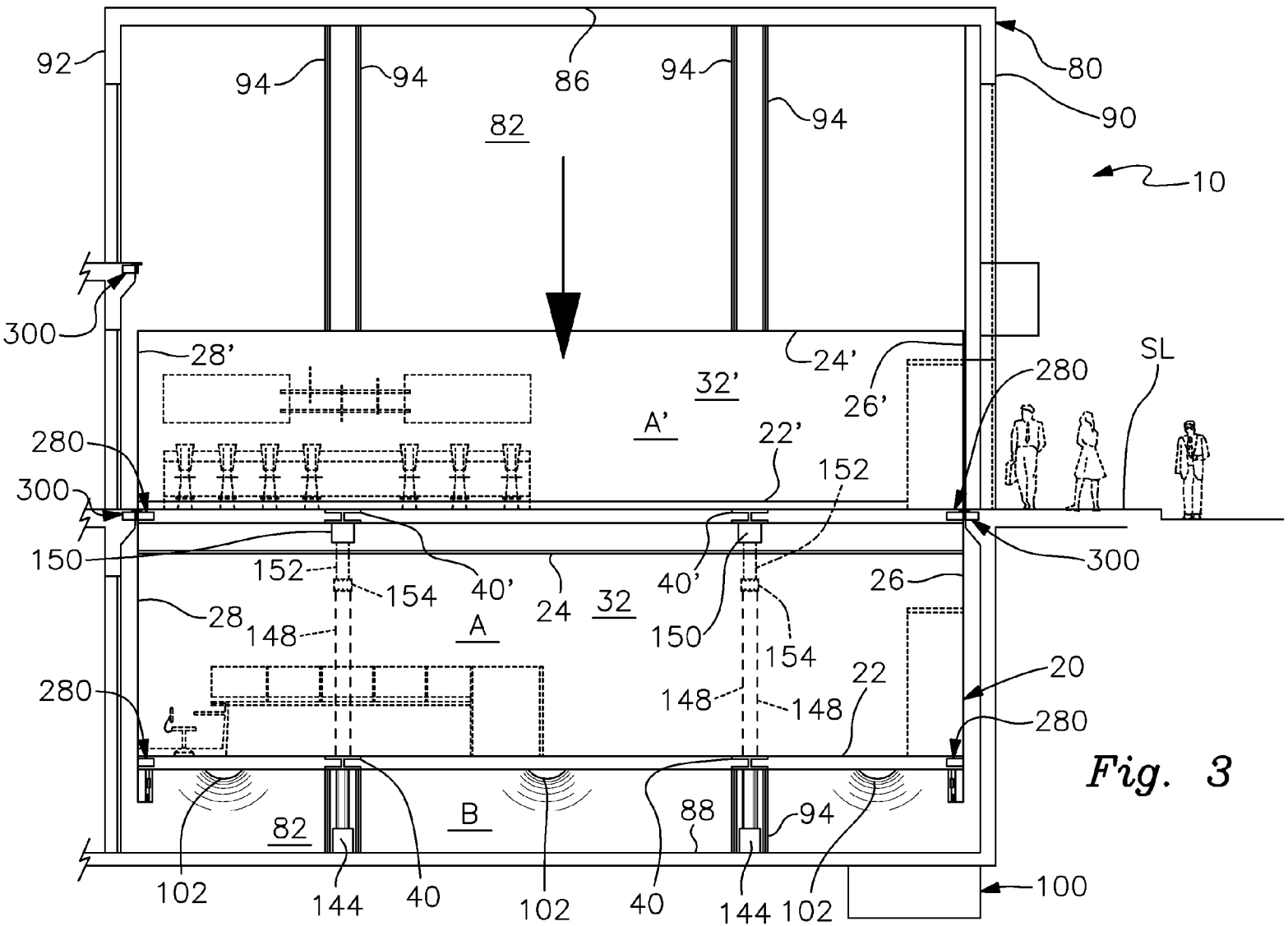
FIG. 3 represents a schematic side view of the instant invention in a second position, wherein the business operating in space A is in the basement, and the business operating in space A' is at street level.
Figure 4:
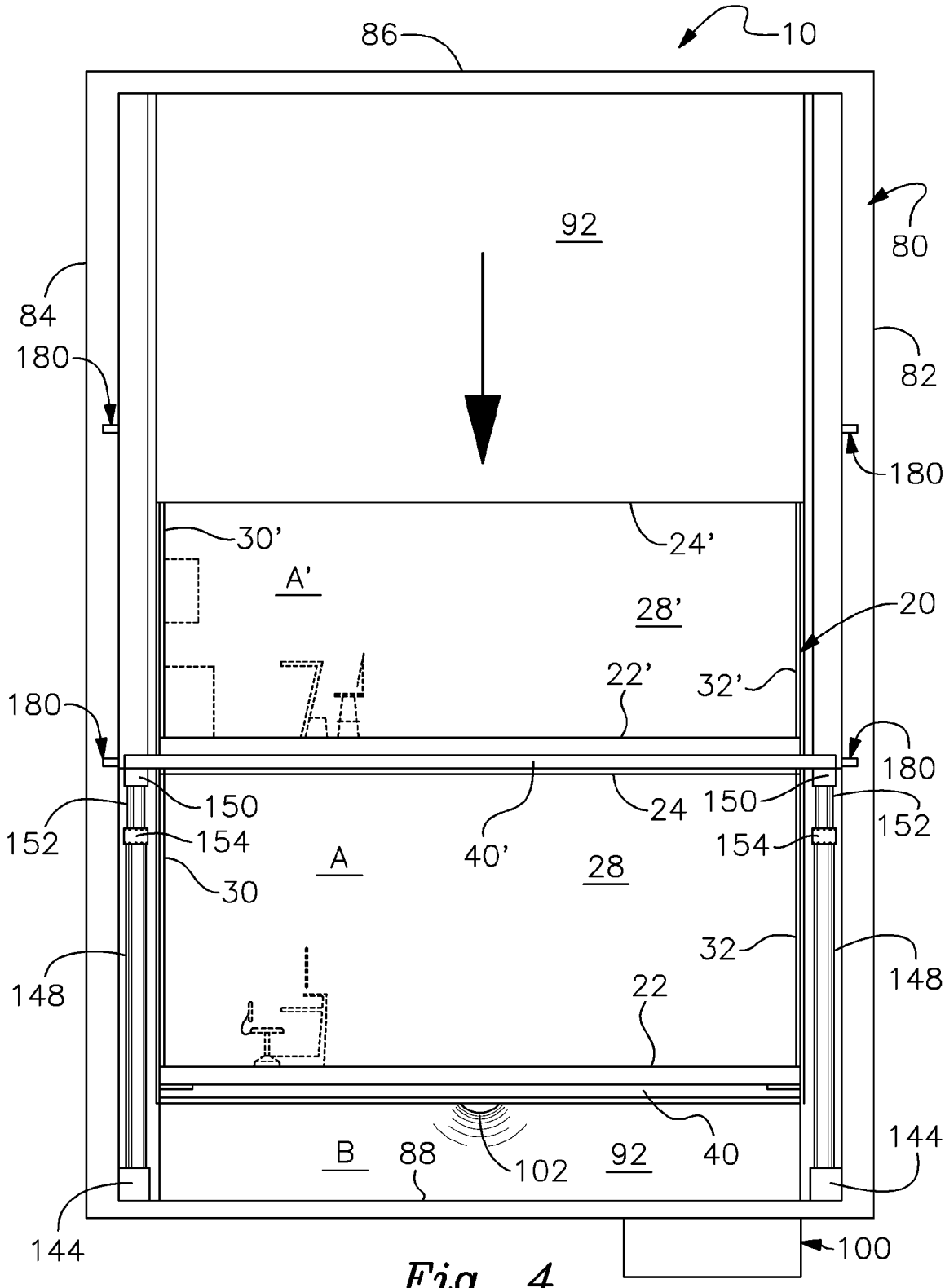
FIG. 4 is a schematic front view of the instant invention as seen in FIG. 3.

As seen in FIGS. 1, 2, 3, and 4, moving housing 20 comprises floor 22, ceiling 24, front wall 26, rear wall 28, and sidewalls 30 and 32 that define space A. Moving housing 20 also comprises floor 22', ceiling 24', front wall 26', rear wall 28', and sidewalls 30' and 32' that define space A'. It is observed that spaces A and A' are vertically disposed with respect to each other on respective multiple contiguous floors within building structure 80. I-shape beams 40 and 40' are mounted at an underside of floors 22 and 22', respectively. As best seen in FIGS. 2 and 4, the ends of I-shape beam 40' protrude from walls 30' and 32' a predetermined distance.

Building structure 80 comprises sidewalls 82 and 84, roof 86, basement floor 88, and front and rear walls 90 and 92. In the preferred embodiment, building structure 80 is a three-floor structure defined by basement B, and spaces A and A'. In the preferred embodiment, basement floor 88 is underground and below street level SL. As best seen in FIG. 5B, perpendicularly mounted to sidewall 82 are supporting walls 94, which in turn have rails 96 longitudinally mounted to thereon. Adjacent to building structure 80 is electrical box 100. Electrical box 100 houses electrical means to operate moving housing 20, lift assembly 140, locking mechanism 180, sealing mechanism 280, and their respective components identified herewith.

Lift assembly 140 comprises bases 144, exterior cylinders 148, mounts 150, pistons 152, and exterior cylinder tops 154. Each base 144 is mounted to basement floor 88. Each exterior cylinder top 154 is mounted to an upper end of respective exterior cylinder 148 to telescopically receive respective piston 152 therethrough. As best seen in FIG. 5B, each mount 150 is fixedly mounted to the upper end of each piston 152 and to a protruding portion of an I-shape beam 40' of moving housing 20. Lift assembly 140 is synchronized to move moving housing 20 from the initial position, as seen in FIGS. 1 and 2, to the second position, as seen in FIGS. 3 and 4, and vice versa. In the initial position as illustrated in FIGS. 1 and 2, the business operating in space A is at street level SL, and the business operating in space A' is one level above the business operating in space A. In the second position as illustrated in FIGS. 3 and 4, the business operating in space A is in the basement, and the business operating in space A' is at street level SL.

Sensors 102 are mounted onto an underside of floor 22. Sensors 102 emit a signal to basement floor 88. In the event an object is identified as occupying space within basement B, an electronic signal is sent to electrical box 100 to prevent moving housing 20 from moving from the initial position, as seen in FIGS. 1 and 2, to the second position, as seen in FIGS. 3 and 4. Such an object can be, but is not limited to, a vehicle, person, or waste.

Figure 5:
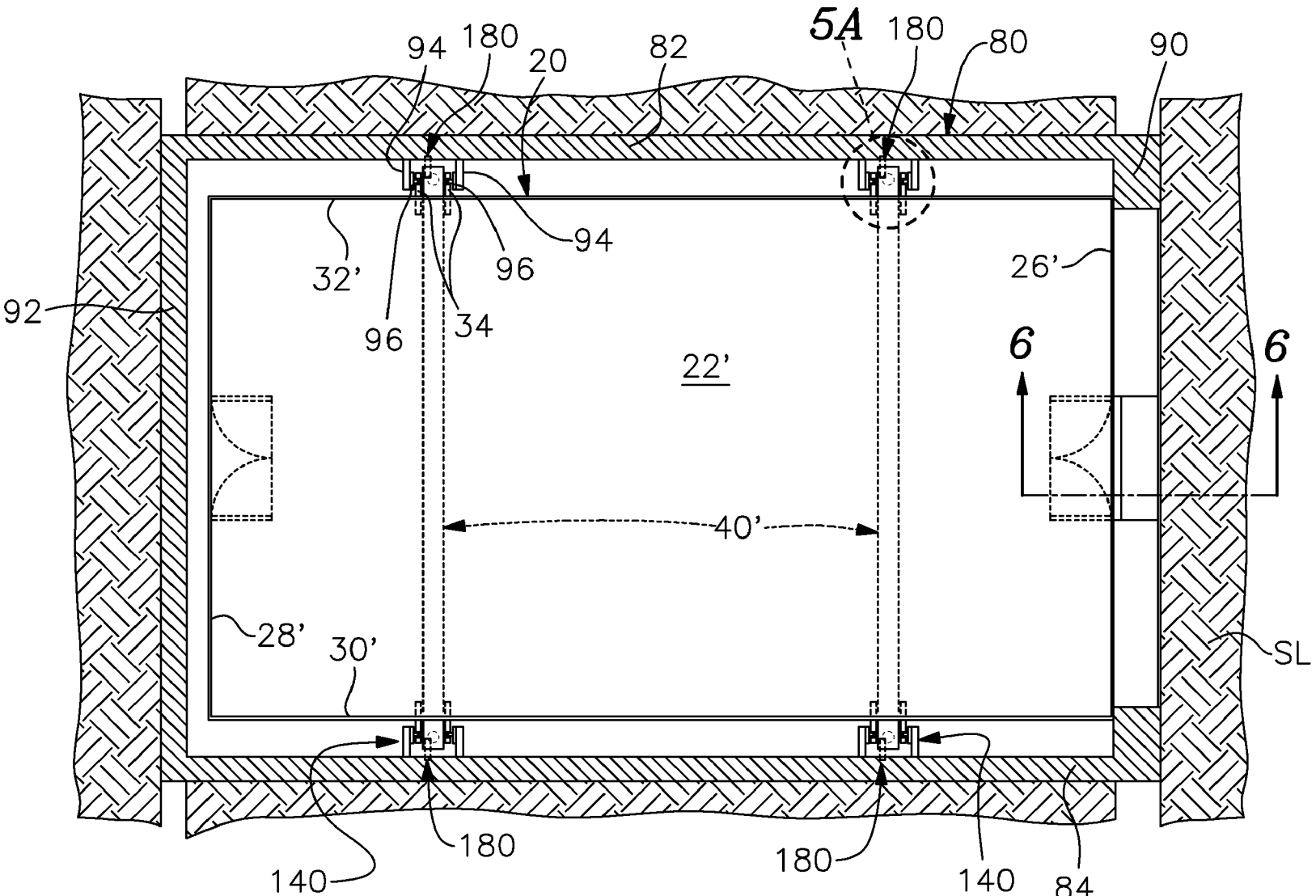
FIG. 5 is a schematic top plan view of the instant invention as seen in the position shown in FIGS. 3 and 4.
Figure 5A:
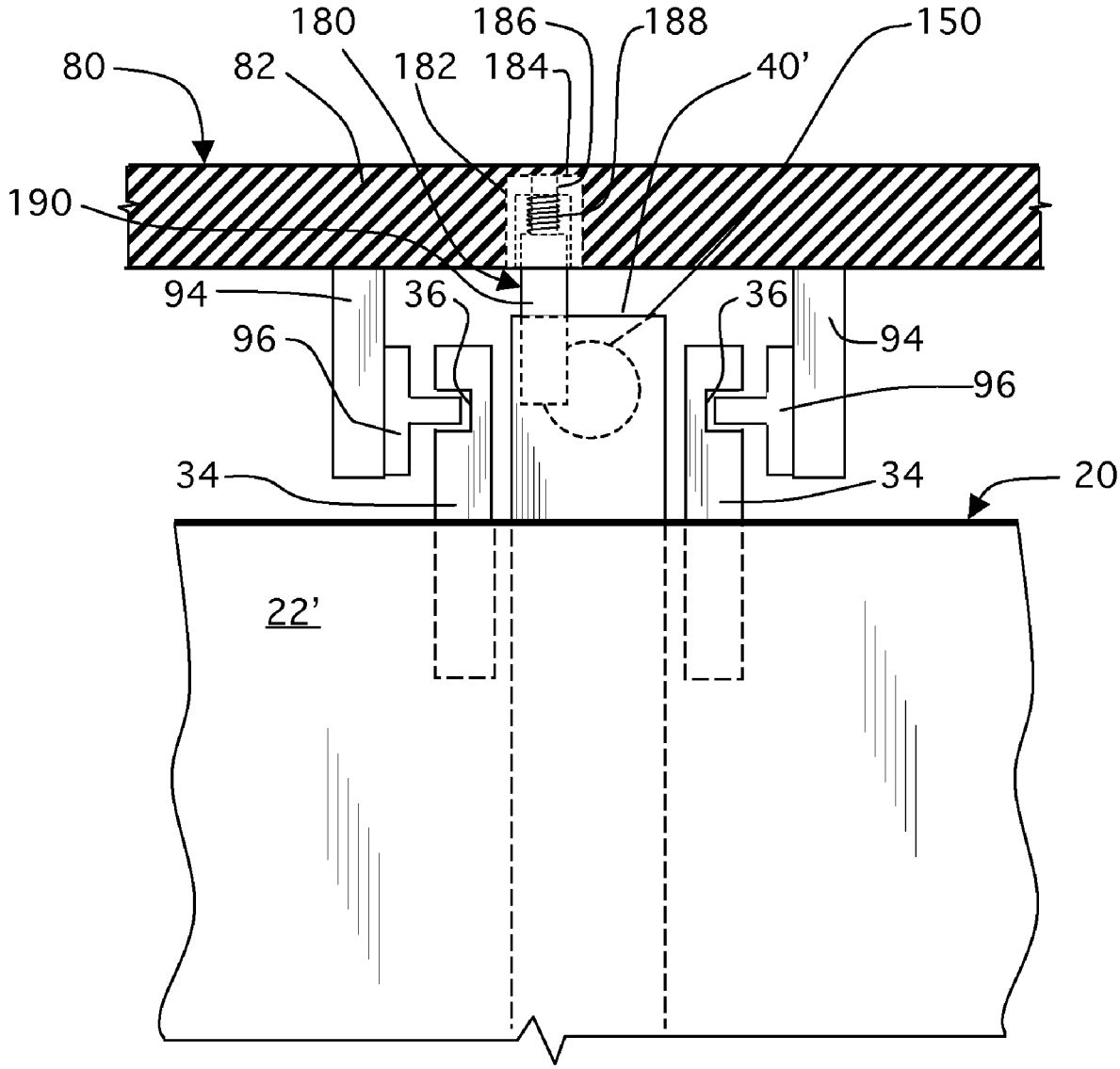
FIG. 5A is a detail view of a lateral locking mechanism as seen in FIG. 5.
Figure 5B:
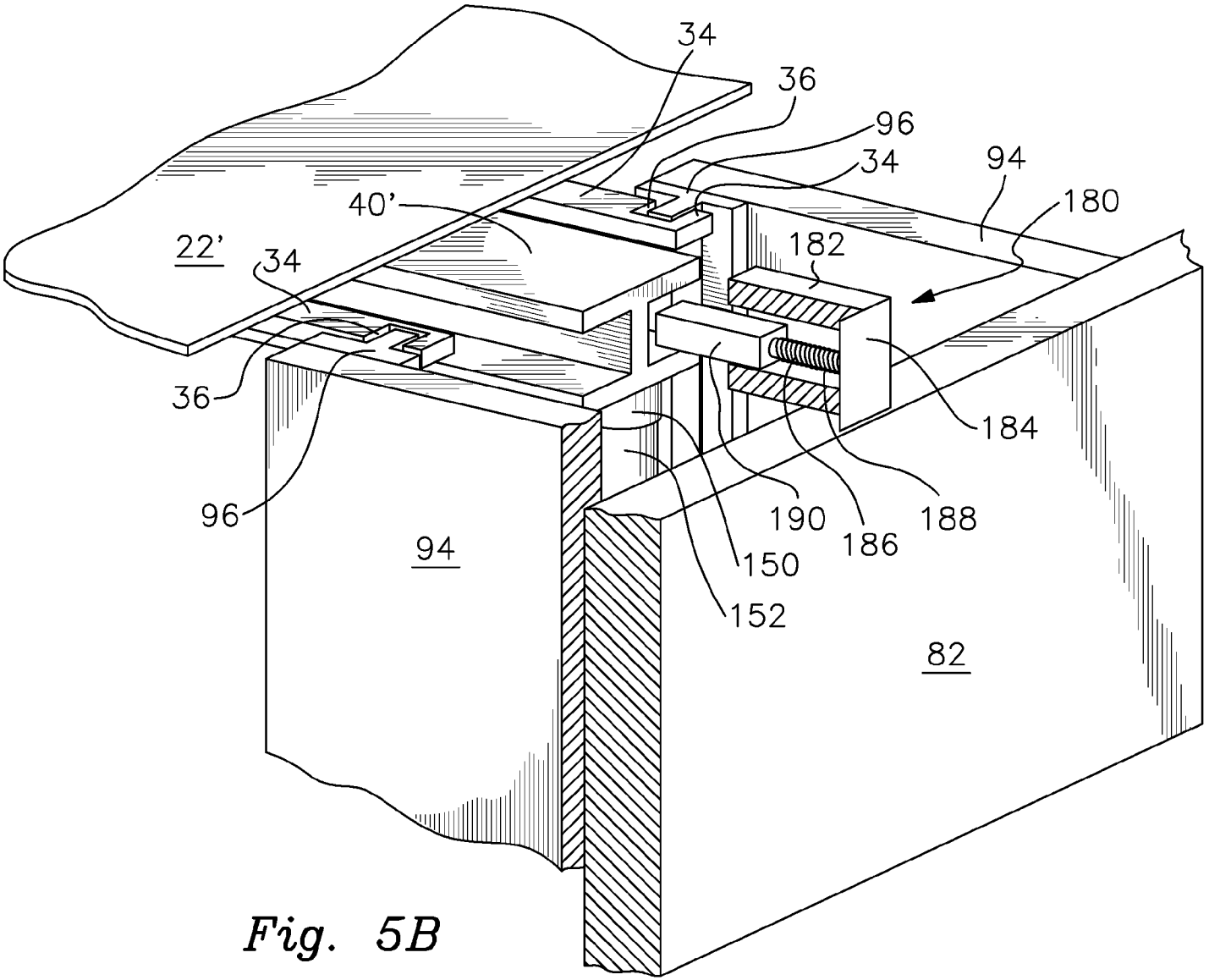
FIG. 5B is an isometric view of a lift assembly with a guide sliding through a rail and the lateral locking mechanism mounted onto an I-shape beam.

As seen in FIGS. 5 and 5A, guides 34 are also mounted to an underside of floors 22 and 22', and have outside channels 36 vertically disposed. Locking mechanism 180 comprises housing lock 182, lock base 184, shaft 186, spring 188 and locking element 190.

As seen in FIG. 5B, when moving retail space system for buildings 10 is ready to be moved, locking element 190 is retracted from I-shape beam 40', allowing the movement of moving housing 20 by lift assembly 140. Once moving housing 20 has attained the initial position illustrated in FIG. 1, or the second position illustrated in FIG. 3, locking mechanisms 180 laterally secure moving housing 20 in place.

Figure 6:
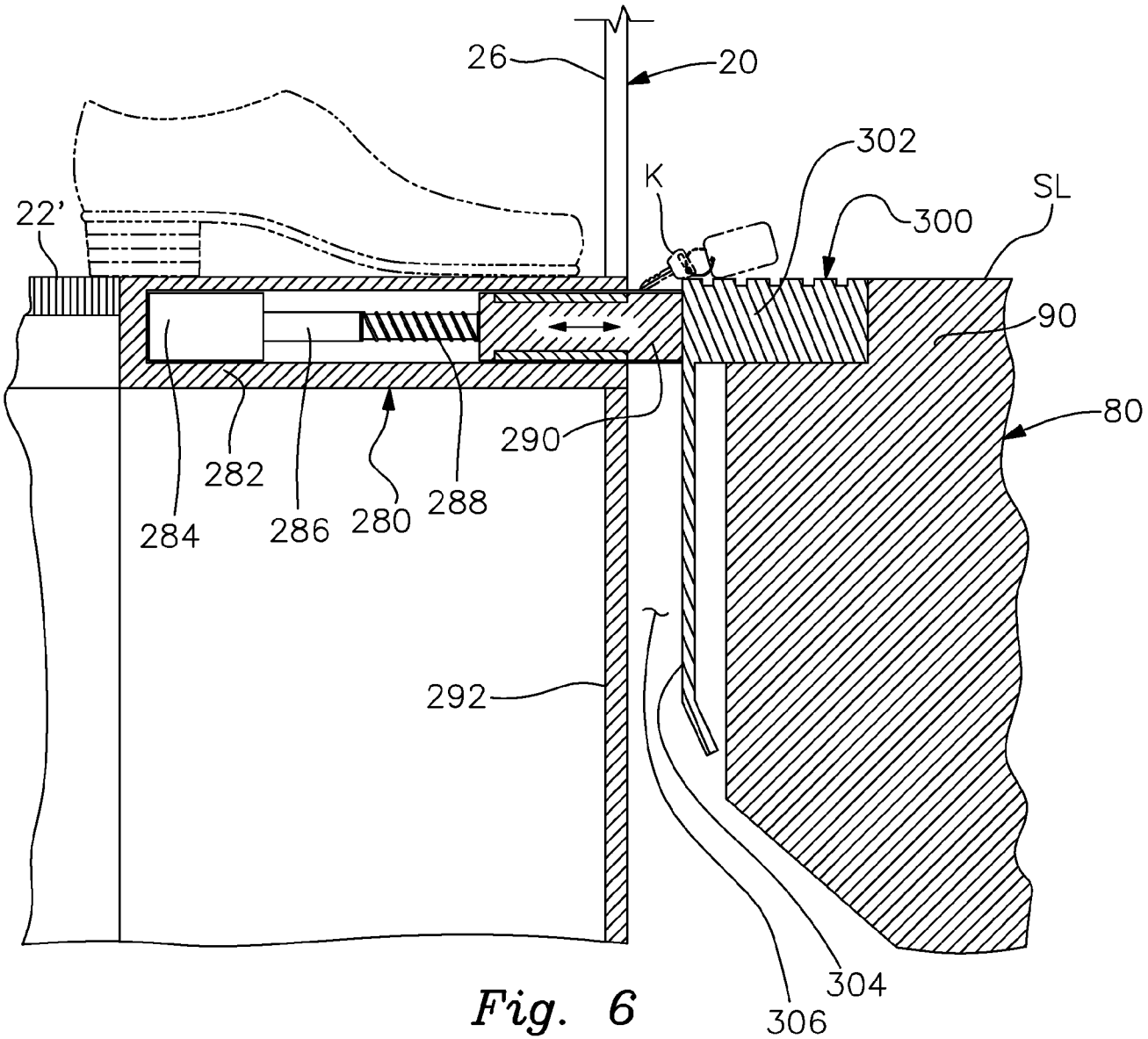
FIG. 6 is a cross-section view of a sealing mechanism taken along lines 6-6 as seen in FIG. 5.

As seen in FIG. 6, sealing mechanism 280 comprises housing lock 282, lock base 284, shaft 286, spring 288, locking element 290, and elongated member 292. Sealing member 300 is mounted below front and rear walls 90 and 92 at below the street level SL. Sealing member 300 comprises horizontal portion 302 and extending vertical member 304 that extends a predetermined distance downwardly into gap 306. When moving housing 20 moves, locking element 290 moves back and extending vertical member 304 acts as a visual barrier to conceal front wall 90. Sealing mechanism 280 prevents small objects from falling through gap 306. More specifically, locking element 290 prevents small objects, such as key K, key chains, coins, paper currency, etc., from falling through gap 306.

In this example, a business operating in space A can be a bank having hours of operation from 8 a.m.-5 p.m. A business operating in space A' can be a bar having hours of operation from 6 p.m.-3 a.m. During 8 a.m.-5 p.m. the bank, operating in space A is in the preferred level, street level SL. During this time, basement B remains free and could be used as a parking lot. This is illustrated in FIGS. 1 and 2. At 5:00 p.m. when the bank closes, sealing mechanisms 280 are disengaged, and locking mechanisms 180 are disengaged to allow moving housing 20 to move downwardly until space A' reaches street level SL. Once in this position, sealing mechanisms 280 are engaged, and locking mechanisms 180 are engaged to prevent moving housing 20 from moving and then their energy source is removed to save energy and avoid accidental movements of moving housing 20. During 6 p.m.-3 a.m. the bar, operating in space A' is now in the preferred level, street level SL. This is illustrated in FIGS. 3 and 4.

Building structure 80 may include common areas, such as restrooms and access to exits outside moving housing 20. In such event, an additional sealing mechanism 280 is installed for each additional entrance. In addition, building structure 80 may include indoor access to the business that is closed. In the event that common areas, including but not limited to: restrooms, kitchens, sinks and others are located inside moving housing 20, moving retail system for buildings 10 could include a flexible piping system for connecting moving housing 20 with the piping system of building structure 80.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A moving retail space system for buildings, comprising:

A) a moving housing (20) comprising at least defined first and second spaces, said first and second spaces are vertically disposed with respect to each other on respective multiple contiguous floors;

B) a building structure (80) housing said moving housing (20), and comprising a basement positioned below a street level;

C) a lift assembly (140) housed within said building structure (80), said lift assembly (140) comprises bases (144), exterior cylinders (148), mounts (150), pistons (152), and exterior cylinder tops (154), said bases (144) are mounted to a basement floor (88) of said basement, said exterior cylinder tops (154) are mounted to an upper end of said exterior cylinders (148) to telescopically receive respective said pistons (152) therethrough, said lift assembly (140) is synchronized to move said moving housing (20) from an initial position to a second position, and vice versa, in said initial position a first business operating in said first space is at said street level, and a second business operating in said second space is located one floor above said first business operating in said first space, in said second position, said first business operating in said first space is in said basement, and said second business operating in said second space is at said street level;

D) at least one locking mechanism (180) comprising a housing lock (182), a lock base (184), a shaft (186), a spring (188) and a locking element (190), said locking mechanism (180) laterally secures said moving housing (20) in place; and E) at least one sealing mechanism (280) to prevent first objects from falling between said moving housing (20) and said building structure (80), said at least one sealing mechanism (280) comprises a housing lock (282), a lock base (284), a shaft (286), a spring (288), a locking element (290), an elongated member (292), and a sealing member (300).

2. The moving retail space system for buildings set forth in claim 1, further characterized in that said sealing member (300) comprises a horizontal portion (302) and extending vertical member (304) that extends a predetermined distance downwardly between said moving housing (20) and said building structure (80).

3. The moving retail space system for buildings set forth in claim 2, further characterized in that said moving housing (20) comprises floor (22), ceiling (24), front wall (26), rear wall (28), and sidewalls (30, 32) that define said first space.

4. The moving retail space system for buildings set forth in claim 3, further characterized in that said moving housing (20) comprises floor (22'), ceiling (24'), front wall (26'), rear wall (28'), and sidewalls (30, 32) that define said second space.

5. The moving retail space system for buildings set forth in claim 4, further characterized in that I-shape beams (40, 40') are mounted at an underside of said floors (22, 22'), respectively.

6. The moving retail space system for buildings set forth in claim 5, further characterized in that said moving housing (20) has a at least one sensor (102) mounted to an underside of said floor (22) that emits a signal to said basement floor (88) if second objects are identified as occupying space within said basement, an electronic signal is sent to an electrical box (100) to prevent said moving housing (20) from moving from said initial position to said second position.

7. The moving retail space system for buildings set forth in claim 6, further characterized in that said second objects can be a vehicle, person, or waste.

8. The moving retail space system for buildings set forth in claim 7, further characterized in that said moving housing (20) further comprises common areas including restrooms, kitchens, sinks and a flexible piping system connected to said building structure (80).

* * * * *